US007407322B2

(12) United States Patent
Engel

(10) Patent No.: US 7,407,322 B2
(45) Date of Patent: Aug. 5, 2008

(54) TRIPOD-MOUNTED MAGNETIC MIXER APPARATUS AND METHOD

(75) Inventor: David Engel, Springwater, NY (US)

(73) Assignee: SPX Corporation, Charlotte, NC (US)

( * ) Notice: Subject to any disclaimer, the term of this patent is extended or adjusted under 35 U.S.C. 154(b) by 151 days.

(21) Appl. No.: 11/205,118

(22) Filed: Aug. 17, 2005

(65) Prior Publication Data

US 2007/0041269 A1 Feb. 22, 2007

(51) Int. Cl.
*B01F 13/08* (2006.01)

(52) U.S. Cl. ..... 366/274; 366/331

(58) Field of Classification Search ..... 366/273–274, 366/262–265, 314, 331, 308; 416/3; 464/29; 417/420

See application file for complete search history.

(56) References Cited

U.S. PATENT DOCUMENTS

| | | | | | |
|---|---|---|---|---|---|
| 2,556,854 | A | * | 6/1951 | Spears et al. | 416/3 |
| 2,859,020 | A | * | 11/1958 | Eddy et al. | 366/274 |
| 3,101,173 | A | | 8/1963 | Jennings | |
| 4,162,855 | A | * | 7/1979 | Bender | 366/274 |
| 4,472,061 | A | | 9/1984 | Mansour | |
| 4,534,656 | A | * | 8/1985 | de Bruyne | 366/247 |
| 5,393,142 | A | * | 2/1995 | Meier | 366/274 |
| 5,568,985 | A | * | 10/1996 | Schutte | 384/478 |
| 5,618,107 | A | * | 4/1997 | Bartsch | 366/279 |
| 5,961,213 | A | | 10/1999 | Tsuyuki et al. | |
| D457,595 | S | | 5/2002 | Ellsworth et al. | |
| 6,517,233 | B2 | * | 2/2003 | Blakley | 366/331 |
| 6,543,928 | B2 | * | 4/2003 | Beebe | 366/273 |
| 6,899,454 | B2 | | 5/2005 | Terentiev | |
| 7,168,848 | B2 | * | 1/2007 | Gigas et al. | 366/273 |
| 2002/0163855 | A1 | | 11/2002 | Beebe | |
| 2002/0176322 | A1 | * | 11/2002 | Kupidlowski | 366/330.3 |
| 2004/0076076 | A1 | | 4/2004 | Hoobyar et al. | |
| 2006/0215488 | A1 | * | 9/2006 | Blakley | 366/331 |
| 2007/0041269 | A1 | * | 2/2007 | Engel | 366/273 |
| 2007/0165485 | A1 | * | 7/2007 | Cai | 366/273 |
| 2007/0286015 | A1 | * | 12/2007 | Markle | 366/273 |

FOREIGN PATENT DOCUMENTS

| | | | |
|---|---|---|---|
| GB | 2196800 A | * | 5/1988 |
| JP | 56-45752 | * | 4/1981 |
| JP | 59-52519 | * | 3/1984 |
| JP | 61-212278 | * | 9/1986 |
| JP | 62-277135 | * | 12/1987 |
| JP | 2-194826 | * | 8/1990 |
| WO | WO 2005/002713 A1 | | 1/2005 |

* cited by examiner

*Primary Examiner*—Charles E Cooley
(74) *Attorney, Agent, or Firm*—Baker & Hostetler LLP

(57) ABSTRACT

A stirring apparatus that includes a coupling member and a bladed impeller that is offset from the coupling member by an extension. The stirring apparatus also includes a support that prevents the apparatus from tipping over. The stirring apparatus further includes an extraction facilitating component designed to allow for easier removal of the apparatus from a tank. In addition, a method for stirring a substance in a tank.

15 Claims, 4 Drawing Sheets

TRIPOD-MOUNTED MAGNETIC MIXER APPARATUS AND METHOD

FIELD OF THE INVENTION

The present invention relates generally to mixing apparatuses and methods. More particularly, the present invention relates to an apparatus and method of magnetically mixing and/or agitating substances.

BACKGROUND OF THE INVENTION

Many industries, such as the chemical and pharmaceutical industries, require mixing of substances (e.g., chemicals) in extremely clean environments. In order to meet the requirements of these industries, specially-designed mixing tanks and stirring mechanisms have been developed.

Substances in many of the above-mentioned tanks are discharged from the tanks by being allowed to flow through openings located at or near the bottom of the tanks. Therefore, in order to promote homogeneity of the flows coming out of the tanks, the stirring mechanisms are typically located at the bottom of the tanks.

One currently-available stirring mechanism has a first portion thereof (i.e., an exterior portion) configured to be positioned on the outside of a tank and a second portion (i.e., an interior portion) configured to be positioned on the inside of the tank. Each of the interior portion and the exterior portion have magnets included therein.

The interior portion includes a cavity and, when positioned inside of the tank, the cavity accommodates the insertion therein of a raised feature on the bottom surface of the tank. Because the thickness of the tank is substantially uniform, the raised feature inside of the tank has an associated indentation on the outside of the tank. When the indentation has dimensions that allow for the interior portion to be inserted into the indentation, the interior portion may be magnetically coupled to the exterior portion through the tank wall at the location of the indentation.

In operation, once the exterior portion is positioned in the indentation and the raised feature is inserted into the cavity of the interior portion, the exterior portion is rotated about a fixed axis by a motor and a set of gears that are positioned outside of the tank and that are connected to the exterior portion. Because of the magnetic coupling between the interior portion and the exterior portion, as the exterior portion is rotated, the interior portion, which has a set of blades attached thereto, is also rotated. As the interior portion and blades are rotated, the set of blades agitates and/or mixes the substances at the bottom of the tank and a degree of homogeneity is achieved locally at the bottom of the tank.

Because the blades are positioned adjacent to the bottom of the tank, very little fluid flow is possible between the blades and the bottom of the tank. In other words, very little exhaust flow is possible below the bottom of the blades. Therefore, the above-discussed mixing tank is only relatively successful at homogenizing substances at the bottom of a tank.

In addition to the above, because the blades are positioned adjacent to the bottom of the tank, substances at the top of the tank are oftentimes too far away from the blades to be substantially agitated or mixed by the blades. Therefore, the likelihood of achieving a homogeneous mixture throughout the tank using the above-discussed mixing tank is even further reduced. At least in view of the above factors, the composition of substances flowing out of the tank when the tank is relatively full may differ from the composition of substances flowing out of the tank when the tank is relatively empty due, which is an undesirable condition.

Also, the presence of an indentation at the bottom of the tank and the need to position the second portion relative to the indentation makes insertion of the stirring mechanism relatively difficult, particularly in relatively tall tanks. Further, the presence of the indentation makes the tank more difficult to clean than smooth-bottomed tanks.

Accordingly, there is a need in the art to provide an apparatus and method for mixing, agitating or stirring substances that are configured to promote substantial homogeneity throughout a tank. Further, there is a need in the art for such mixing, agitating or stirring apparatuses that may be more easily inserted and removed from a tank, so that the tank may be easily cleaned. Even further, there is a need in the art to provide a mixing apparatus and method for mixing substances that minimize friction and wear, thereby reducing the amount of particulates that get released into a tank during mixing.

SUMMARY OF THE INVENTION

The foregoing needs are met, to a great extent, by certain embodiments of the present invention, wherein in one embodiment a stirring apparatus is provided. The stirring apparatus includes a coupling member that includes a magnet. The stirring apparatus also includes an extension connected to the coupling member. Further, the stirring apparatus includes an impeller connected to the extension at a location remote to the coupling member. In addition, the stirring apparatus includes a support connected to at least one of the coupling member, the extension or the impeller.

According to another embodiment of the present invention, another stirring apparatus is provided. The stirring apparatus includes a tank and a first coupling member positioned inside the tank, wherein the first coupling member includes a first magnet. The stirring apparatus also includes a second coupling member positioned outside the tank, wherein the second coupling member includes a second magnet. The stirring apparatus further includes an extension connected to the first coupling member. In addition, the stirring apparatus includes an impeller connected to the extension, wherein the impeller includes a plurality of blades. Further, the stirring apparatus includes a support connected to the extension, wherein the support includes a first leg, a second leg and a third leg.

According to yet another embodiment of the present invention, a method of stirring a substance in a tank is provided. The method includes rotating a first coupling member positioned inside of a tank using a force exerted by a second coupling member positioned outside of the tank. The method also included rotating an impeller using the first coupling member, wherein the impeller is connected to the first coupling member at a location remote to the first coupling member. The method further includes stabilizing the impeller using a support that is detached from the tank.

In accordance with still another embodiment of the present invention, another stirring apparatus is provided. This stirring apparatus includes means for magnetically rotating a coupling member positioned inside of a tank. The stirring apparatus also includes means for separating an impeller from the coupling member and for connecting the impeller and the coupling member. In addition, the stirring apparatus includes means for stabilizing the impeller, wherein the means for stabilizing means is detached from the tank.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
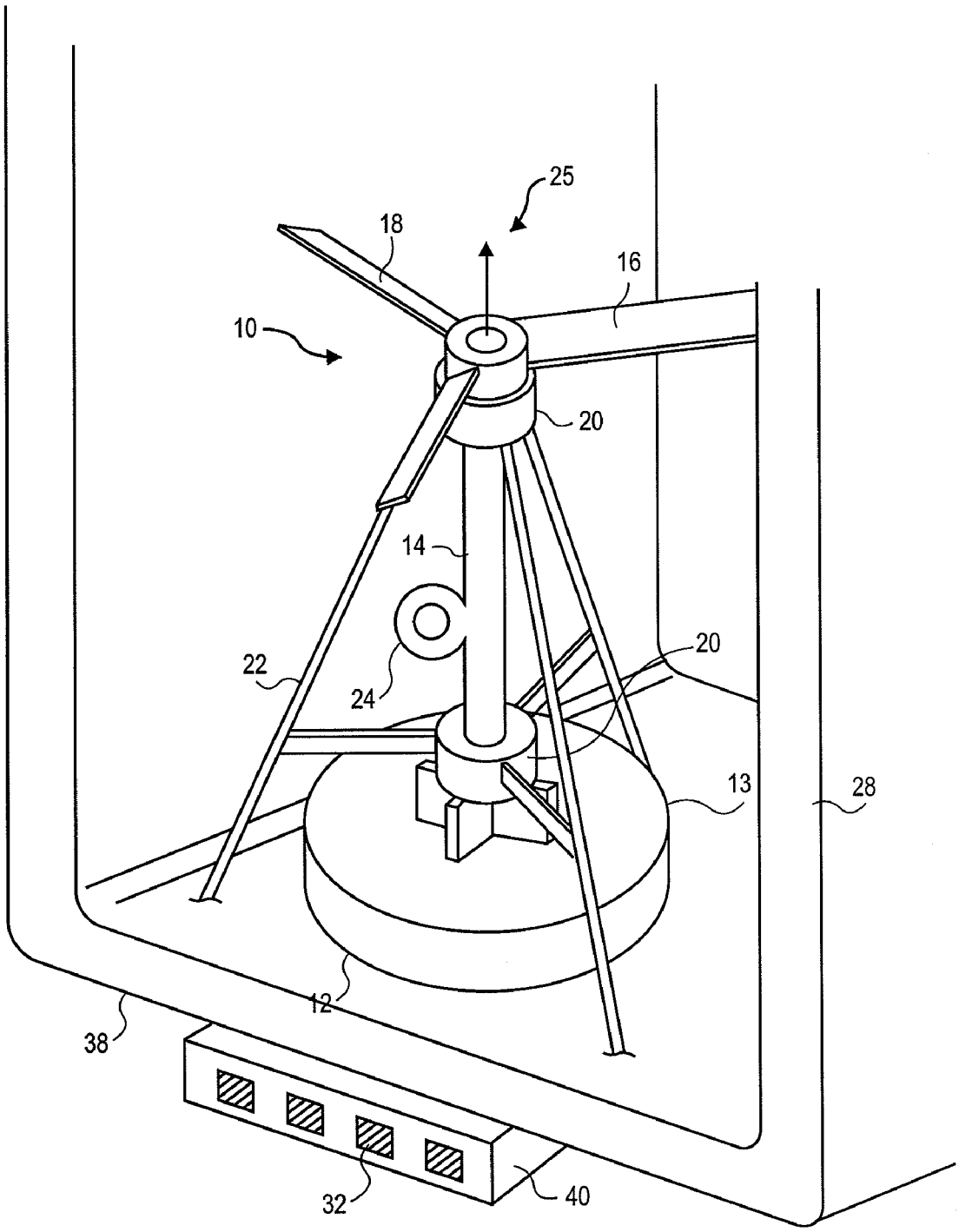
FIG. 1 is a perspective view of a stirring apparatus in accordance with an embodiment of the present invention.

Various preferred embodiments of the present invention provide for a magnetic mixing apparatus and method for mixing, agitating or mixing substances or the like. At least in view of the above shortcomings of the prior art, novel devices, systems and methods have been developed to stir substances in tanks. Certain embodiments of the present invention will now be described with reference to the drawing figures, in which like reference numbers refer to like parts throughout.

FIG. 1 is a perspective view of a stirring apparatus 10 in accordance with an embodiment of the present invention. The stirring apparatus 10 includes a coupling member 12 at the bottom thereof and an extension 14 extending away from the top surface 13 of the coupling member 12. In FIG. 1, the coupling member 12 is positioned at one end of the extension 14 and an impeller 16 is positioned at the opposite end thereof. A plurality of blades 18 are attached to the impeller 16. Surrounding the extension 14 are two sets of bearings 20. Physically connected to each of the bearings 20 is a support 22. Positioned on the extension 14 is an extraction facilitating component 24.

According to certain embodiments of the present invention, the stirring apparatus 10 is positioned at the bottom of a tank and is used to mix, stir or agitate substances in the tank. For example, during operation, the coupling member 12 is positioned either directly adjacent to or in close proximity with the bottom surface of a tank. Also, the coupling member 12 includes one or more magnets that may either be incorporated into the structure of the coupling member 12 or that may be attached to the coupling member 12.

As mentioned above and depicted in FIG. 1, the extension 14 is connected to the coupling member 12 and extends away from the top surface 13 along the central axis 25 of the coupling member 12. Therefore, when the stirring apparatus 10 is utilized with a mixing tank, the extension 14 typically extends away from the bottom surface of the mixing tank.

The extension 14 is illustrated in FIG. 1 as a cylindrical shaft extending generally perpendicular from the top surface of the coupling member 12. However, extensions 14 with alternate geometries and that do not extend perpendicular from the top surface of the coupling member 12 are also within the scope of the embodiments of the present invention. For example, extensions 14 having square, oval or octagonal cross-sections may also be used.

According to certain embodiments of the present invention, in order to facilitate the turnover of substances at the bottom of the tank and to promote homogeneity of substances throughout the tank, the extension 14 has a length equal to approximately ½ of the diameter of the impeller 16. According to these embodiments, if the impeller 16 were to be designed to have a diameter of 24 inches, the extension 14 would be designed to measure approximately 12 inches. Such a configuration promotes not only flow of substances above the impeller 16 but also facilitates exhaust flow below the impeller 16. However, extensions 14 having alternate lengths are also within the scope of the present invention. For example, the extension may have a length equal to approximately ½, ⅔ or ¾ of the height of the tank.

As mentioned above in connection with FIG. 1, the coupling member 12 is positioned at one end of the extension 14 and the impeller 16 is positioned at the opposite end of the extension 14. However, the coupling member 12 and/or the impeller 16 may be positioned away from the ends of the extension 14 in alternate embodiments of the present invention, so long as the impeller 16 is at a location that is remote to the coupling member 12. Also, other components (e.g., additional impellers) maybe positioned along the extension 14.

The impeller 16 as illustrated in FIG. 1 includes three blades 18, each positioned at a non-parallel angle relative to the top surface 13 of the coupling member 12. Alternatively, one or more of the blades 18 may be positioned perpendicularly relative to the top surface of the coupling member 12. Also, more or less than three blades 18 may be used.

As illustrated in FIG. 1, each of the sets of bearings 20 is connected to the support 22 and is positioned between the extension 14 and the support 22. More specifically, each of the bearings 20 is preferably disposed around the extension 14, wherein the extension 14 extends through the center of each set of bearings 20. Each of the bearings 20 functions to reduce friction between the extension 14 and the support 22 when the extension 14 spins relative to the support 22. Due to the relatively low level of friction, very few particulates are generated due to wear while the stirring apparatus 10 is in operation.

Two sets of bearings 20 are illustrated in FIG. 1, however, more or less bearing sets may be utilized. Also, any type of bearing may be used according to the present invention. For example, ball bearings and journal bearings may be used. Further, although the two sets of bearings 20 are illustrated in FIG. 1 as being positioned between the extension 14 and the support 22, other embodiments of the present invention allow for one or more bearings to be positioned at other locations in the stirring apparatus 10. For example, one or more bearings may be positioned between the support 22 and the coupling member 12 or between the support 22 and the impeller 16.

The support 22 illustrated in FIG. 1 is a tripod having a first, second and third leg that are each connected to each other. However, alternative embodiments of the support may include more or less than three legs. Also, the support 22 may be of any geometric configuration that prevents or at least hinders the stirring apparatus 10 from tipping over relative to the bottom surface of a tank in which the stirring apparatus 10 is included.

As illustrated in FIG. 1, the extraction facilitating component 24 illustrated in FIG. 1 is connected directly to the extension 14. However, according to other embodiments of the present invention, an extraction facilitating component 24 may be positioned elsewhere in or on the stirring apparatus 10. For example, the extraction facilitating component 24 may be directly or indirectly connected to any other component of the stirring apparatus 10. Also, although the extraction facilitating component 24 is a ring, the size or shape of the extraction facilitating component 24 is not limited to the depicted ring geometry. For example, the extraction facilitating component 24 may be semi-circular, square, etc.

The extraction facilitating component 24 typically provides a location on the stirring apparatus 10 that can be conveniently engaged by an extraction tool. For example, the extraction facilitating component 24 may be designed to accommodate the passing of a hook therethrough. In such instances, if the hook is connected to a pole that is long enough to reach the bottom of the tank, a technician at the top of the tank may pull the stirring apparatus 10 out of the tank using the hook. This allows for removal of the stirring apparatus 10 without a technician entering the tank, reducing the likelihood of tank contamination.

Preventing tank contamination is particularly important with respect to relatively large tanks which can be used with the stirring apparatuses. For example, in 1,000-gallon or a 5,000-gallon tanks where the stirring apparatus 10 may be positioned ten feet or further away from a hatch at the top of the tank, it is particularly desirable to allow a technician to remove the stirring apparatus 10 without entering the tank.

Figure 2:
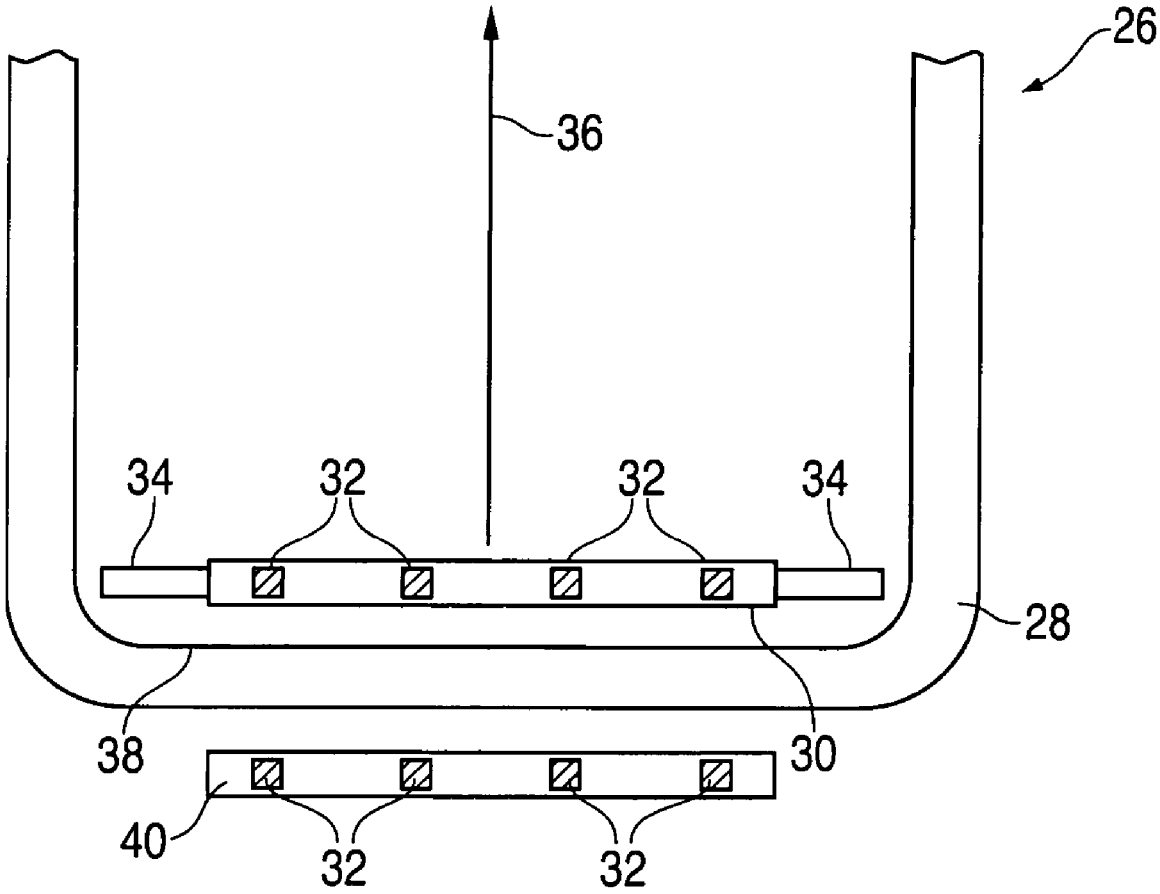
FIG. 2 is a cross-sectional view of a portion of a stirring apparatus in accordance with another embodiment of the present invention.

FIG. 2 is a cross-sectional view of a portion of a stirring apparatus 26 in accordance with another embodiment of the present invention. According to certain embodiments of the present invention, the portion of the stirring apparatus 26 illustrated in FIG. 2 may replace the coupling member 12 illustrated in FIG. 1.

The portion of the stirring apparatus 26 illustrated in FIG. 2 is positioned inside of a tank 28 and includes an interior coupling member 30 that is preferably a flat plate. The interior coupling member 30 illustrated in FIG. 2 has four magnets 32 incorporated therein. However, many additional magnets may be either incorporated into or attached to the interior coupling member 30 and as few as one magnet may be incorporated into or attached to the interior coupling member 30.

As illustrated in FIG. 2, a plurality of stirring components or blades 34 are connected to the interior coupling member 30. When the portion of the stirring apparatus 26 illustrated in FIG. 2 is incorporated into the stirring apparatus 10 illustrated in FIG. 1, the extension 14 typically extends along the central axis 36 of the interior coupling member 30.

Although only two blades 34 are illustrated in FIG. 2, many additional blades may be utilized and as few as one blade may be utilized. Also, although the blades 34 are illustrated as substantially rectangular, other blade geometries are also within the scope of certain embodiments of the present invention. Further, one or more of the blades 34 may be placed at non-perpendicular angles relative to the bottom of the tank 28.

As illustrated in FIG. 2, the bottom surface 38 of the tank 28 is substantially flat and an exterior coupling member 40 is positioned below the internal coupling member 30 on the exterior of the tank 28. The interior coupling member 30 and the exterior coupling member 40 each include one or more magnets 32. Therefore when the exterior coupling member 40 is rotated about the central axis 36 using a motor and/or gears that are connected to the exterior coupling member 40, the exterior coupling member 40 exerts a magnetic force on the internal coupling member 30 and causes rotation of the interior coupling member 30 (and the attached blades 34) about the central axis 36 as well. The aforementioned rotation stirs, mixes or agitates substances within the tank 28.

As mentioned above, the portion of the stirring apparatus 26 illustrated in FIG. 2 may be used in combination with the stirring apparatus 10 illustrated in FIG. 1. In this exemplary combination, the interior coupling member 30 may be used to agitate or stir substances near the bottom surface of the tank while the substances closer to the top of a tank may be stirred or agitated by the impeller 16, promoting homogeneity throughout the tank. Also, in this exemplary combination, the support 22 will function to stabilize the stirring apparatus and will minimize the likelihood of the stirring apparatus 10 tipping over while in operation. The attractive magnetic forces between the magnets 32 in the exterior coupling member 40 and the interior coupling member 30 will also assist to further stabilize the stirring apparatus 10.

Figure 3:
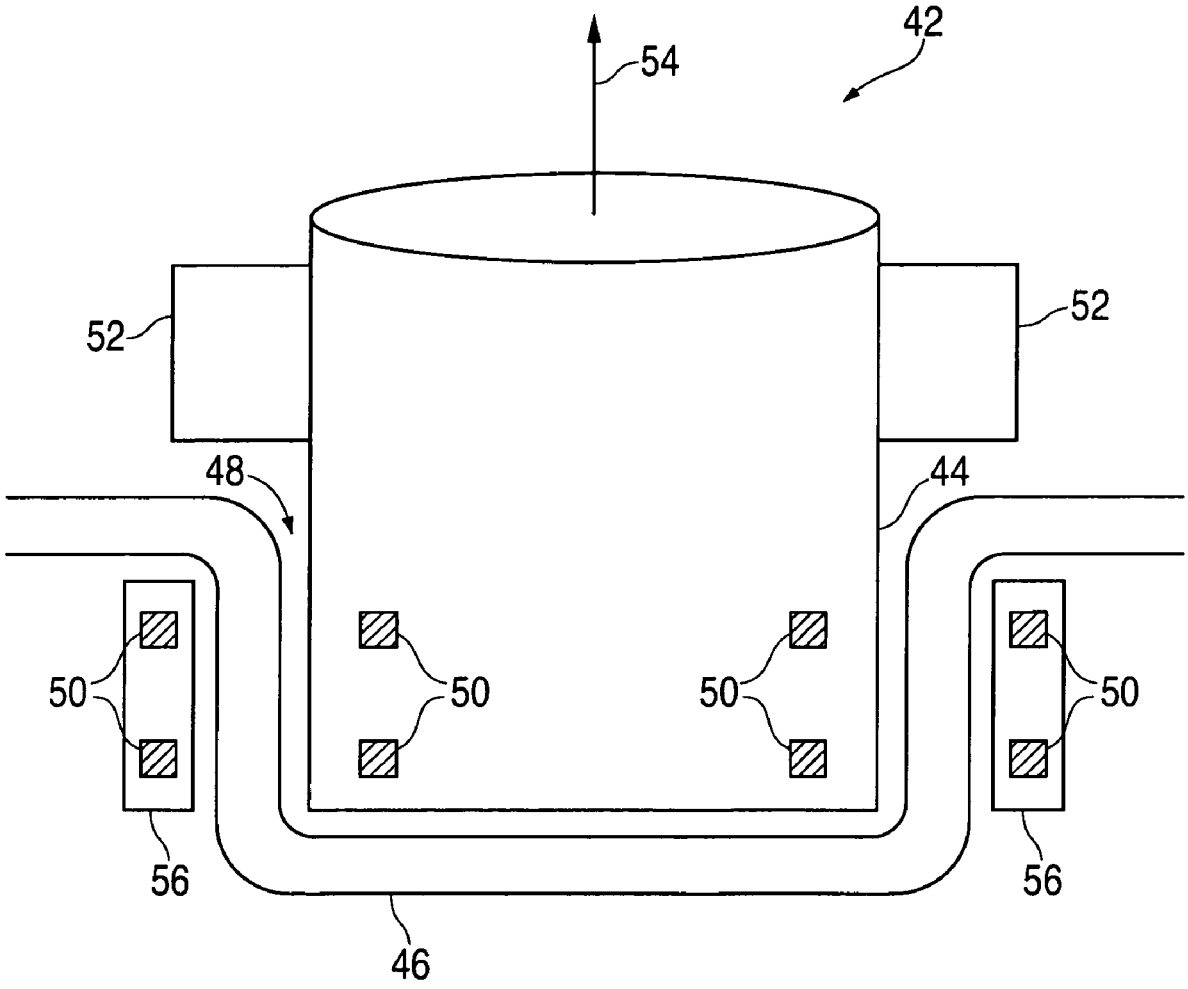
FIG. 3 is a cross-sectional view of a portion of a stirring apparatus in accordance with yet another embodiment of the present invention.

FIG. 3 is a cross-sectional view of a portion of a stirring apparatus 42 in accordance with yet another embodiment of the present invention. According to certain embodiments of the present invention, the portion of the stirring apparatus 42 illustrated in FIG. 3 may replace the coupling member 12 illustrated in FIG. 1.

The portion of the stirring apparatus 42 illustrated in FIG. 3 includes an interior coupling member 44 that is positioned within the interior of a tank 46. More specifically, a portion of the interior coupling member 44 is positioned in a cavity 48 on a bottom surface of the tank.

The coupling member 44 includes a plurality of magnets 50 and a plurality of blades 52 that are connected to the coupling member. Although only four magnets and two blades are illustrated in FIG. 3, additional or fewer magnets and/or blades may be incorporated into and/or attached to the interior coupling member 44. The magnets are positioned within the cavity 48 and the blades are positioned above the cavity. In embodiments of the present invention where the portion of the stirring apparatus 42 illustrated in FIG. 3 replaces the coupling member 12 illustrated in FIG. 1, the extension 14 illustrated in FIG. 1 typically extends along the central axis 54 of the coupling member 44 illustrated in FIG. 3.

As illustrated in FIG. 3, an exterior coupling member 56 is positioned adjacent to and encircles the outside of the cavity 48. The exterior coupling member 56 includes four magnets 50. However, many additional magnets 50 or as few as one magnet 50 may also be used. The exterior coupling member 56 may take the form of a continuous or discontinuous ring that surrounds the periphery of the cavity 48 or some other portion of the tank 46. Furthermore, the exterior coupling member 56 may surround both the periphery of the cavity 48 and the bottom of the cavity 48, effectively fitting as a sleeve around the cavity 48.

During operation of a mixing apparatus that includes the portion 42 illustrated in FIG. 3, the exterior coupling member 56 rotates or spins around the exterior of the cavity 48. As the exterior coupling member 56 rotates, a magnetic force is exerted upon the interior coupling member 44, causing the interior coupling member 44 to spin or rotate within the cavity 48 and tank 46. As the interior coupling member 44 rotates, the plurality of blades 52 that are attached thereto cause the substances within the tank 46 to be mixed, stirred or agitated.

When the portion of the stirring apparatus 42 illustrated in FIG. 3 replaces the coupling member 12 illustrated in FIG. 1 and is incorporated into the stirring apparatus 10 illustrated in FIG. 1, the blades 52 may be used to agitate, mix or stir substances at the bottom of the tank 46 while the impeller 16 mixes, stirs or agitates substances located a distance away from the bottom of the tank 46. Also, when the portion of the stirring apparatus 42 illustrated in FIG. 3 is incorporated into the stirring apparatus 10 of FIG. 1, the support 22 stabilizes the stirring apparatus 10 and minimizes the likelihood of the stirring apparatus 10 tipping over.

Figure 4:
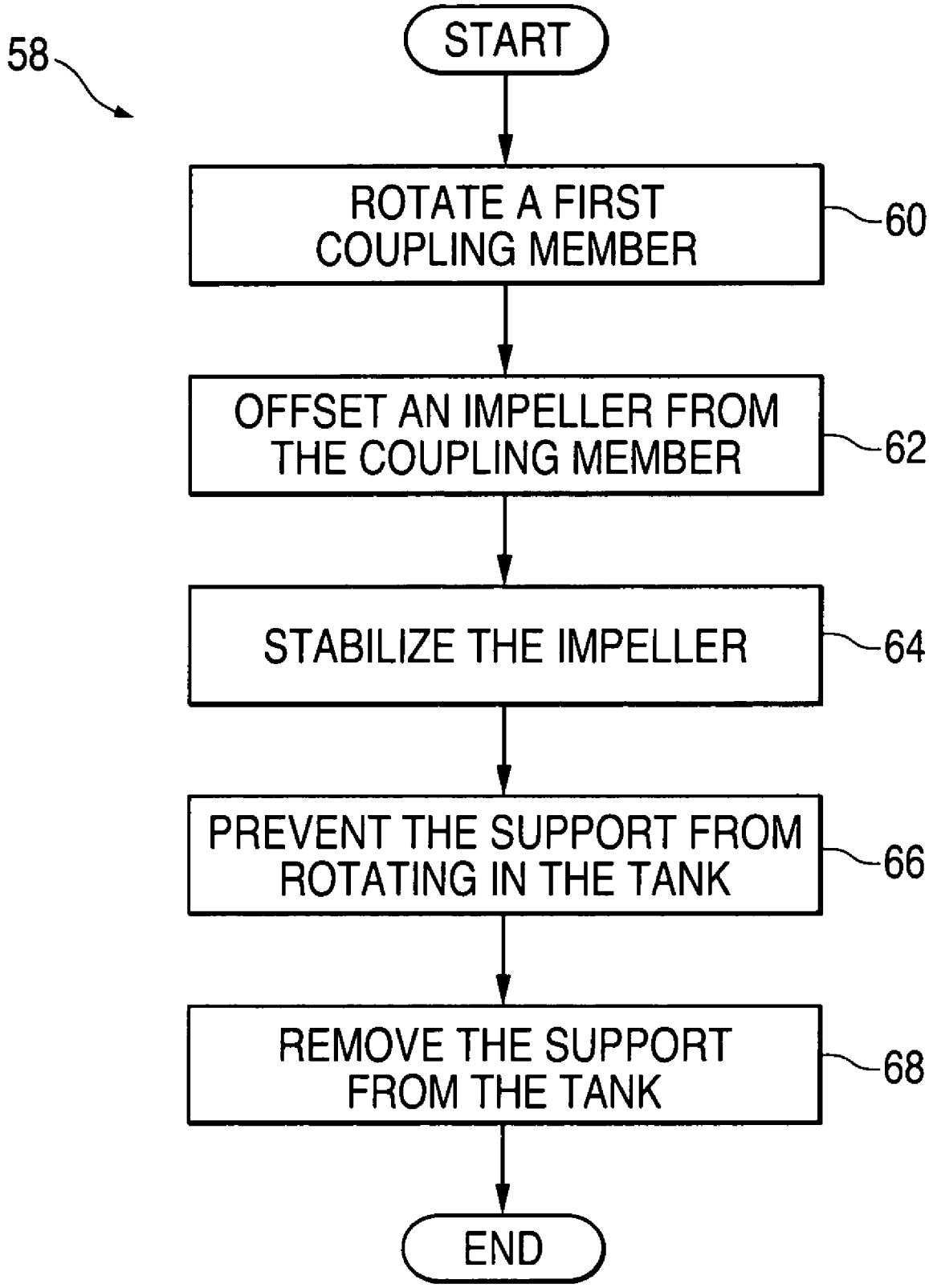
FIG. 4 is a flowchart illustrating a method for stirring a substance in accordance with an embodiment of the present invention.

FIG. 4 is a flowchart 58 illustrating a method for stirring a substance in accordance with an embodiment of the present invention. Step 60 identifies rotating a first coupling member positioned inside of a tank using a force exerted by a second coupling member positioned outside of the tank. Step 60 may be implemented, for example, by selecting a first coupling member having either a substantially flat or plate-like shape, such as the interior coupling member 30 illustrated in FIG. 2, or having a portion that may be inserted into a cavity in the bottom of a tank. The second coupling member may, for example, have a cylindrical shape, such as the exterior coupling member 56 illustrated in FIG. 3 or a flat shape, such as the exterior coupling member 40 illustrated in FIG. 2.

The rotating step 60 also includes applying a magnetic field to rotate the coupling member. This step may be implemented, for example, by rotating or spinning the exterior coupling member 56 illustrated in FIG. 3 or by rotating or spinning the exterior coupling member 40 illustrated in FIG. 2.

As illustrated in FIG. 4, step 62 comprises offsetting or separating an impeller from the first coupling member, wherein the impeller is connected to the first coupling member. Offsetting step 62 may be implemented, for example, by positioning an impeller at a distance from a bottom surface of the tank that is substantially equal to ½ of a diameter of the impeller. Offsetting step 62 may also, for example, be implemented by positioning an impeller at a location that is approximately ¼, ⅓, ½, ⅔ or ¾ of the way between a bottom surface of a tank and a top surface of the tank. Typically, step 62 is implemented using an appropriately-sized extension.

Step 64 comprises stabilizing the impeller using a support that is detached from the tank. This step of stabilization may be accomplished using a support such as, for example, the support 22 illustrated in FIG. 1. Step 64 is particularly useful in those embodiments of the present invention where the stirring apparatus 10 is neither bolted, welded nor otherwise fixedly attached to the tank. In other words, some embodiments of step 64 allow for a support 22 to stabilize a stirring apparatus 10 that otherwise merely sits on the bottom surface of a tank and relies upon gravity and/or magnetic forces to retain the stirring apparatus 10 at the bottom of the tank.

Step 66 comprises preventing the support from rotating within the tank. Preventing step 66 may be implemented, for example, by providing components inside of the tank that abut one or more legs of the support and thereby prevent the rotation thereof. Also, indentations that accommodate entry of a portion of the legs of the support may be used to implement step 66.

Step 68 comprises removing the support from the tank through a top opening of the tank. According to certain embodiments of the present invention, a hook can be attached to a portion of the support, impeller, or coupling member to lift the stirring apparatus out of the tank. In alternative embodiments, an extraction facilitating component can be provided that more easily interfaces with an extraction device.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A mixing system, comprising:
- a vessel having a lower vessel wall;
- a rotating drive member disposed outside of the lower vessel wall and having at least one drive magnet;
- a rotatable driven coupling member disposed inside of the lower vessel wall and having at least one driven magnet;
- a shaft extending inward into the vessel and attached to the driven coupling member;
- a plurality of impellers extending radially from the shaft;
- a support frame comprising: at least three legs, with each leg having a lower end affixed to the lower wall of the vessel, and extending upwardly into the vessel, with the three legs each having an upper end; an upper bearing ring that supports the shaft for rotation, wherein each leg upper end supports the upper bearing ring; a lower bearing ring that supports the shaft for rotation; and
- a plurality of struts, each strut extending radially inward from a respective leg to support the lower bearing ring, wherein the shaft is supported by the upper and lower bearing rings, and the upper and lower bearing rings are supported axially and radially by the legs and the struts, so that the shaft and the driven coupling member are suspended and the driven coupling member is held at an axial location spaced above the lower vessel wall.

2. A system according to claim 1, further comprising a ring attached to the shaft to facilitate removal of the shaft from the vessel.

3. The system according to claim 1, wherein the legs form a tripod arrangement.

4. The system according to claim 1, wherein the driven coupling member comprises a flat plate affixed to the lower end of the shaft.

5. The system according to claim 1, wherein the driven coupling member comprises a disc affixed to the lower end of the shaft.

6. The system according to claim 1, wherein each bearing ring comprises a ball bearing.

7. The system according to claim 1, wherein each bearing ring comprises a journal bearing.

8. A mixing system, comprising:
- a vessel having a lower vessel wall;
- a rotating drive means disposed outside of the lower vessel wall and having at least one drive magnet;
- a rotatable driven coupling means disposed inside of the lower vessel wall and having at least one driven magnet;
- a shaft extending inward into the vessel and attached to the driven coupling means;
- a plurality of impellers extending radially from the shaft;

a support frame comprising: at least three legs, with each leg having a lower end affixed to the lower wall of the vessel, and extending upwardly into the vessel, with the three legs each having an upper end; an upper bearing means that supports the shaft for rotation, wherein each leg upper end supports the upper bearing means; a lower bearing means that supports the shaft for rotation; and a plurality of struts, each strut extending radially inward from a respective leg to support the lower bearing means, wherein the shaft is supported by the upper and lower bearing means, and the upper and lower bearing means are supported axially and radially by the legs and the struts, so that the shaft and the driven coupling means are suspended and the driven coupling means is held at an axial location spaced above the lower vessel wall.

9. A system according to claim 8, further comprising a ring attached to the shaft to facilitate removal of the shaft from the vessel.

10. The system according to claim 8, wherein the legs form a tripod arrangement.

11. The system according to claim 8, wherein the driven coupling means comprises a flat plate affixed to the lower end of the shaft.

12. The system according to claim 8, wherein the driven coupling means comprises a disc affixed to the lower end of the shaft.

13. The system according to claim 8, wherein each bearing means comprises a ball bearing.

14. The system according to claim 8, wherein each bearing means comprises a journal bearing.

15. A mixing method for use with a vessel having a lower vessel wall, a rotating drive member disposed outside of the lower vessel wall and having at least one drive magnet, a rotatable driven coupling member disposed inside of the lower vessel wall and having at least one driven magnet, a shaft extending inward into the vessel and attached to the coupling member, and a plurality of impellers extending radially from the shaft comprising:

supporting the shaft using a support frame comprising: at least three legs, with each leg having a lower end affixed to the lower wall of the vessel, and extending upwardly into the vessel, with the three legs each having an upper end; an upper bearing ring that supports the shaft for rotation, wherein each leg upper end supports the upper bearing ring; a lower bearing ring that supports the shaft for rotation; and a plurality of struts, each strut extending radially inward from a respective leg to support the lower bearing means, wherein the shaft is supported by the upper and lower bearing means, and the upper and lower bearing means are supported axially and radially by the legs and the struts, so that the shaft and the driven coupling member are suspended and the driven coupling member is held at an axial location spaced above the lower vessel wall.

* * * * *